United States Patent [19]

Korpi et al.

[11] Patent Number: 4,596,124

[45] Date of Patent: Jun. 24, 1986

[54] POWER ASSIST HIDE APPLICATOR

[75] Inventors: Kenneth W. Korpi, Red Wing; Carleton E. Jennrich, Welch; Demetrius G. Jelatis, Red Wing, all of Minn.

[73] Assignee: Sargent Sub (Delaware), Inc., Red Wing, Minn.

[21] Appl. No.: 680,008

[22] Filed: Dec. 10, 1984

[51] Int. Cl.[4] ..... C14B 1/02

[52] U.S. Cl. ..... 69/40; 69/19

[58] Field of Search ..... 69/2, 19, 19.1, 19.3, 69/37, 40, 46

[56] References Cited

U.S. PATENT DOCUMENTS

| | | | |
|---|---|---|---|
| 157,691 | 12/1874 | Lockwood | 69/46 |
| 179,928 | 7/1876 | Lockwood | 69/46 |
| 3,059,461 | 10/1962 | Damon, Jr. et al. | 69/46 X |
| 3,664,162 | 5/1972 | Schrade et al. | 69/46 |

FOREIGN PATENT DOCUMENTS

| | | | |
|---|---|---|---|
| 243657 | 2/1912 | Fed. Rep. of Germany | 69/46 |
| 2531455 | 2/1984 | France | 69/2 |
| 1007661 | 10/1965 | United Kingdom | 69/19 |
| 1095826 | 12/1967 | United Kingdom | 69/46 |

*Primary Examiner*—Wm. Carter Reynolds

*Attorney, Agent, or Firm*—Burd, Bartz & Gutenkauf

[57] ABSTRACT

A mechanized power assisted apparatus for flattening and stretching wet tanned hides on a smooth flat plate preparatory to drying in the course of leather manufacture. The apparatus comprises support means holding a squeegee-type slicker element for positioning closely adjacent to a hide-carrying plate. The slicker element has a smooth straight edge which is rotatable in a plane parallel to the surface of the plate. The slicker support means is associated with a powered travel means for moving the support means in a plane parallel to and spaced from the surface of the hide-carrying plate and over a hide supported on that plate. Powered thrust means are associated with the slicker element for moving the element into and out of contact with the wet hide and for exerting force on the slicker element. Spaced apart control means are provided for actuating the power assist means for manipulating the slicker element over the surface of a hide in simulation of manual hide application.

24 Claims, 14 Drawing Figures

ELECTRICAL CONTROL CIRCUIT DIAGRAM

POWER ASSIST HIDE APPLICATOR

BACKGROUND OF THE INVENTION

1. Field of the Invention

This invention relates to a mechanized power assisted apparatus for applying tanned hides on a smooth flat plate preparatory to drying in the course of leather manufacture.

Tanning of leather is an ancient art. From the earliest times, man has changed rough raw animal hides into supple wearable materials. This involves mechanical and chemical treatment of the hide to remove blood, lymph, adhering flesh, hair, etc. and enzymatic and bacterial action to render the hide soft and supple. These are wet treatments. The leather is commonly dyed and treated with oils and fats for lubrication, softness, strength and water-proofing. After dyeing and fat-liquoring, leather contains about 45 to 60 percent water and is commonly dried to about 14 percent moisture. Chemical and physical reactions take place during drying. Loose tannins, dyes and oils spread uniformly, penetrate deeply and are firmly fixed. Uneven drying causes migration of unfixed tannin, dye and oil to the surface, resulting in undesirable dark stains and non-uniform appearance.

A common industry technique of drying wet hides is so-called "paste drying." Hides are literally pasted by the grain side to large flat plates of adhesive coated glass, porcelain or metal, and then are passed through a tunnel dryer. After drying to the desired moisture content, the hide is stripped off yielding flat, smooth grain, large area leather sheets ready for finishing and fabrication into various leather goods. Alternatively, the wet hides may be vacuum dried after being similarly spread out on a flat smooth polished plate. Vacuum drying is faster but requires costly equipment.

Whether to be paste dried or vacuum dried, it is essential that the wet hide be in intimate contact with the smooth planar surface without any entrapped air bubbles. The wet hide is applied to the surface and manually smoothed by means of a squeegee-type slicker element. This is most commonly in the form of a flat edged blade which is manipulated over the surface of the wet hide from the center to the edge working out any entrapped air or water between the hide and plate surfaces. At the same time, the hide is stretched somewhat increasing its area. This is tough, arduous work requiring great strength and staying power. Typically, in the course of a day's work, fatigue sets in toward the end of the day and productivity is materially reduced. The principal objective of the present invention is to provide a mechanical power assisted apparatus to perform this back-breaking task, with its attendant advantages of lessened fatigue, higher productivity, and more uniform product.

2. The Prior Art

No prior art pertinent to the invention is known.

SUMMARY OF THE INVENTION

Broadly stated, the invention is directed to a power assist hide applicator apparatus for flattening and stretching a wet hide against a smooth planar surface for drying. The apparatus is adapted for positioning closely adjacent to the smooth flat plate upon which a hide is adhered for drying according to conventional tanning practice. The apparatus comprises support means holding a slicker element for positioning closely adjacent to a hide-carrying plate. The slicker element has a smooth flat edge which is rotatable in a plane parallel to the surface of the plate. The slicker element support means is associated with a power assisted travel means for moving the support means in a plane parallel to and spaced from the surface of the hide-carrying plate and over an area substantially coextensive with the area of a hide supported on that plate. Power assisted thrust means are associated with the slicker element for moving the element on a path perpendicular to the hide-carrying plate into and out of contact with a wet hide carried on the plate and for exerting force on the slicker element. Spaced apart manually operable control means are provided for actuating the power assist means for manipulating the slicker element over the surface of a hide in simulation of manual hide application.

BRIEF DESCRIPTION OF THE DRAWINGS

The invention is illustrated in the accompanying drawings in which corresponding parts are identified by the same numerals and in which:

FIG. 11 is a schematic diagram of the servo system showing the manner in which the manual control means actuates the power units for assisting the movements of the slicker element;

FIG. 11A shows a cross-over relief detail of the system of FIG. 11;

FIG. 13 is a schematic diagram of the pneumatic system illustrating the manner in which thrust force is exerted on the slicker element.

DETAILED DESCRIPTION OF THE PREFERRED EMBODIMENT

The invention is described with reference to use in connection with vertical hide-carrying plates as commonly used in tanneries for paste drying in tunnel dryers. It is to be understood, however, that the concepts of the invention are equally applicable for operation in a horizontal plane for smoothing and stretching hides on horizontal surfaces as are commonly used in vacuum drying.

Figures 1, 2:
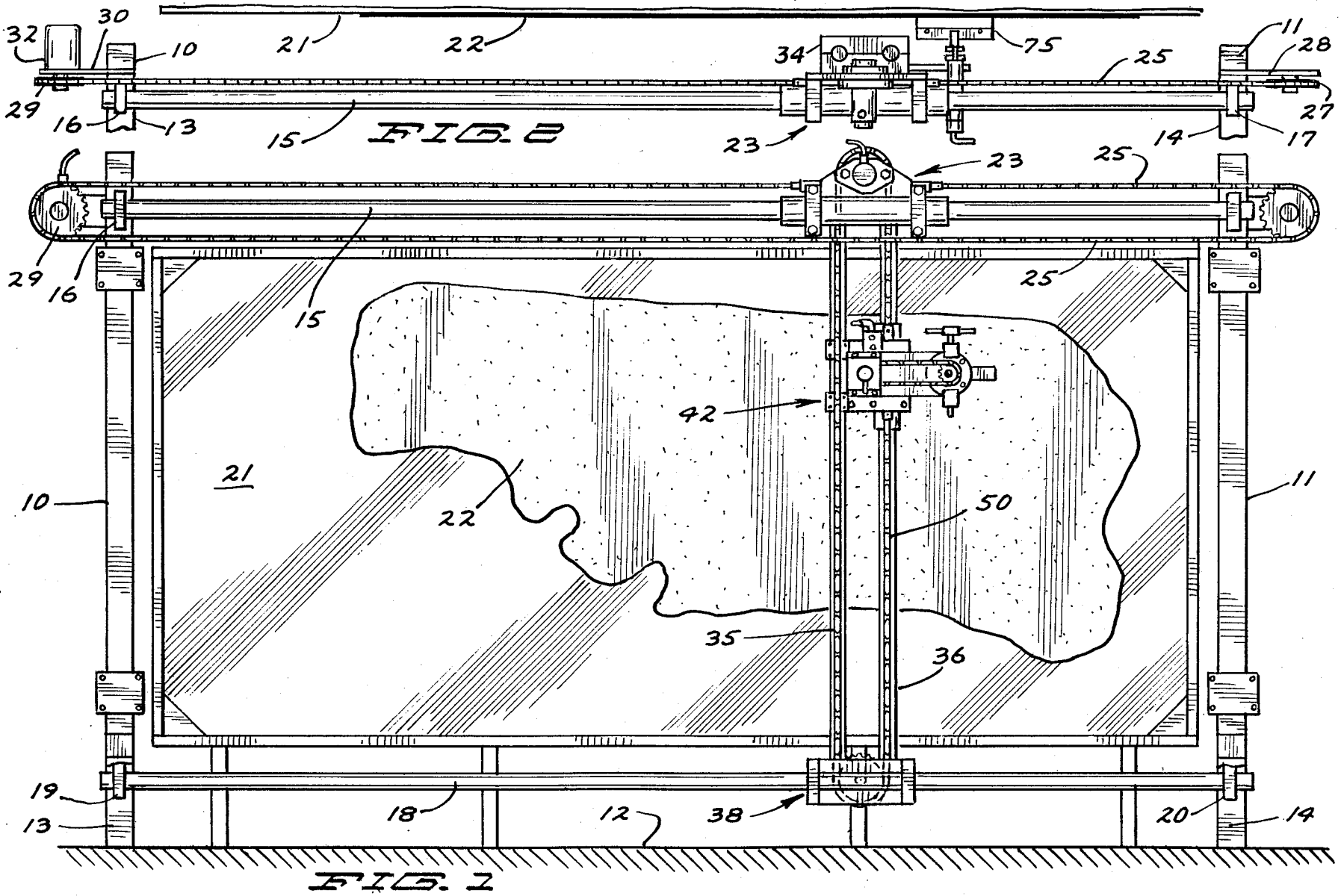
FIG. 1 is a vertical elevation of one form of hide paster apparatus according to the present invention.
FIG. 2 is a top plan view thereof.

Referring now to the drawings, and particularly to FIGS. 1 and 2, there is shown one form of apparatus according to the present invention in vertical configuration. The apparatus includes a frame having left and right parallel widely spaced apart vertical posts or standards 10 and 11 supported on a floor 12, as by feet 13 and 14, respectively. An upper horizontal guide rail 15, in the form of an elongated cylindrical tube or shaft, is supported at its opposite ends by brackets 16 and 17 which in turn are supported by standards 10 and 11, respectively. A corresponding lower guide rail 18 is supported by brackets 19 and 20. Together standards 10 and 11 and rails 15 and 18 define a rectangular frame of size between about 4'×10' to 6'×12', corresponding generally to the dimensions of a rigid smooth surfaced hide-carrying plate 21 upon which a wet animal hide 22 is spread. As best seen in FIG. 2, the apparatus frame is positioned closely adjacent and parallel to the plate 21. In practice, the hide is pasted or otherwise adhered to the plate. Usually this is done at a work station preceding that of the applicator apparatus and the plate is moved into position on a traveling conveyor.

Figures 3, 4:
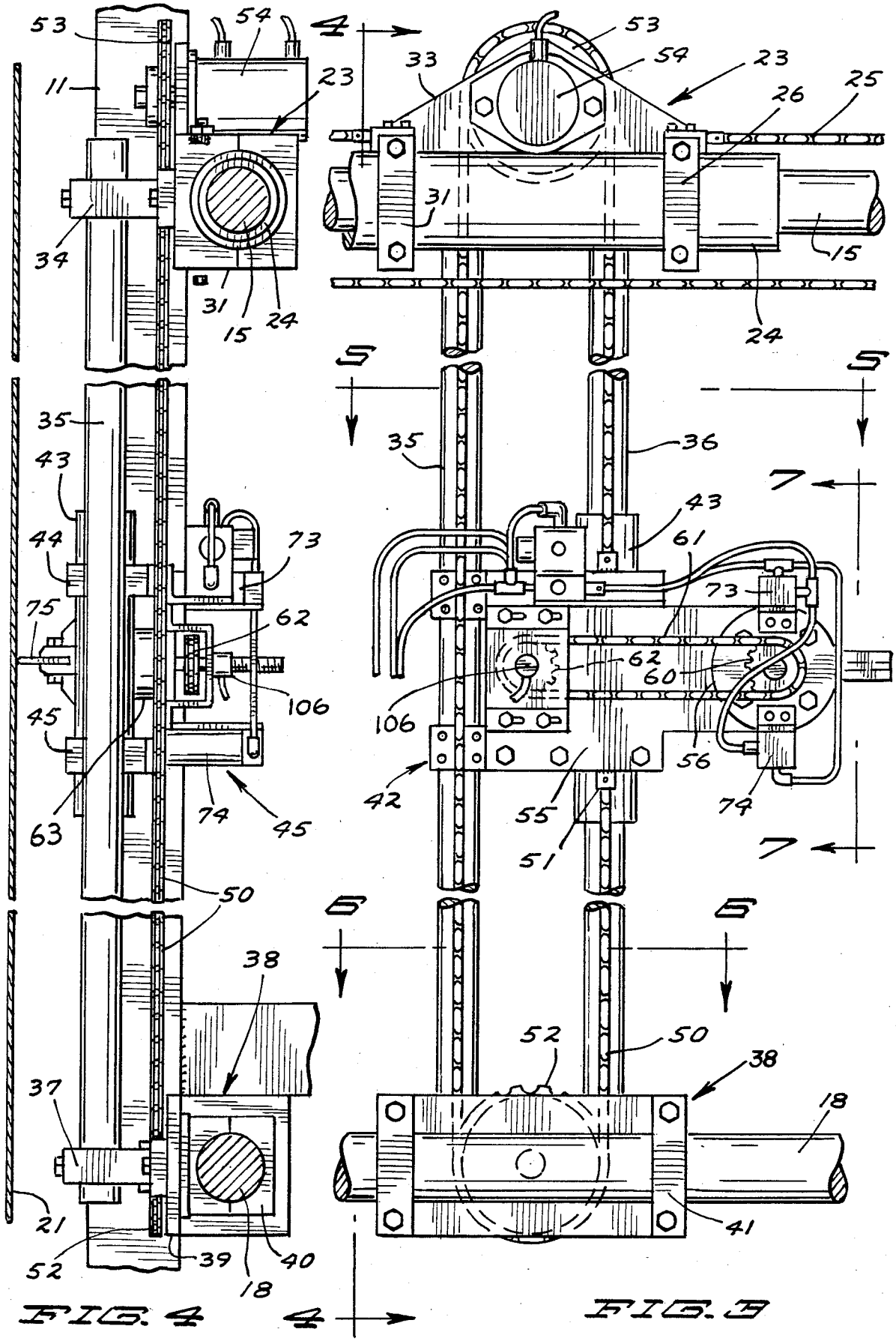
FIG. 3 is a fragmentary front elevation on an enlarged scale showing a support carriage for the slicker element mounted for X and Y movement.
FIG. 4 is a vertical section on the line 4—4 of FIG. 3 and in the direction of the arrows.

An upper X motion carriage, indicated generally at 23, is supported on guide rail 15 for horizontal movement therealong. As best seen in FIGS. 3 and 4, carriage 23 is supported on the guide rail 15 by means of a cylindrical bushing 24. For movement, one end of a sprocket chain 25 or similar linear drive means is secured to a bracket 26 forming part of the X motion carriage. Drive chain 25 extends horizontally to and around idler sprocket 27 supported on plate 28 from the top of standard 11 (FIG. 1), and thence horizontally to drive sprocket 29 supported by plate 30 from the top of standard 10. The drive chain then extends back to the X motion carriage where its opposite end is secured to bracket 31 supported on the bushing. Drive sprocket 29 is driven by an hydraulic or electric motor 32 which is also supported by plate 30.

Figure 6:
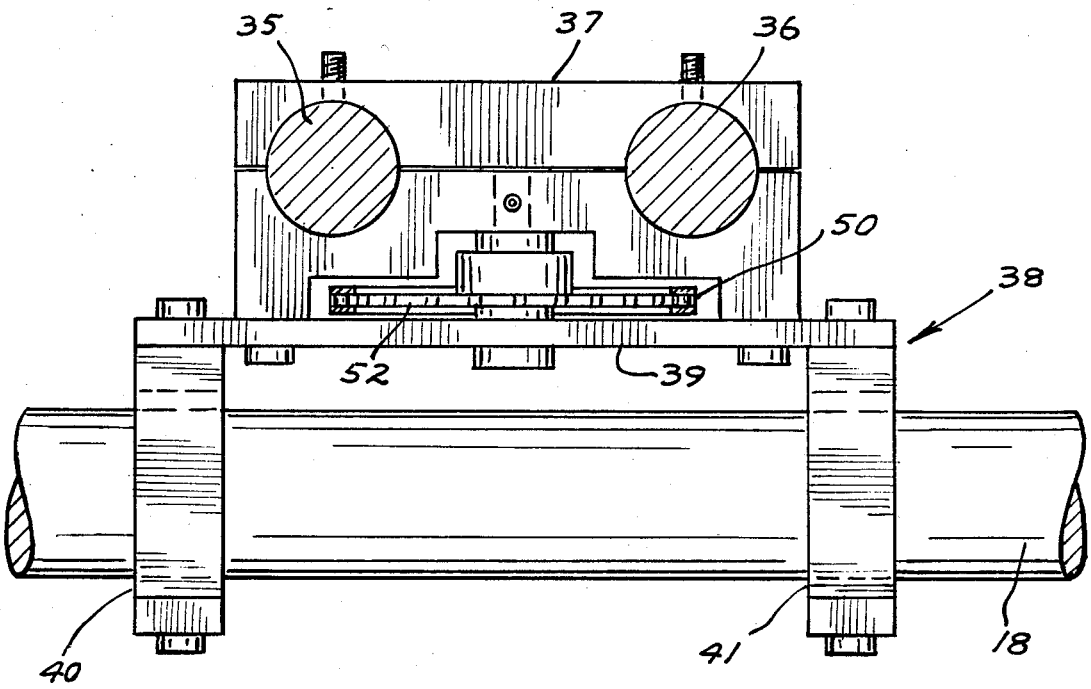
FIG. 6 is a horizontal section on a further enlarged scale on the line 6—6 of FIG. 3 and in the direction of the arrows, showing details of a lower X motion carrier.
Figure 7:
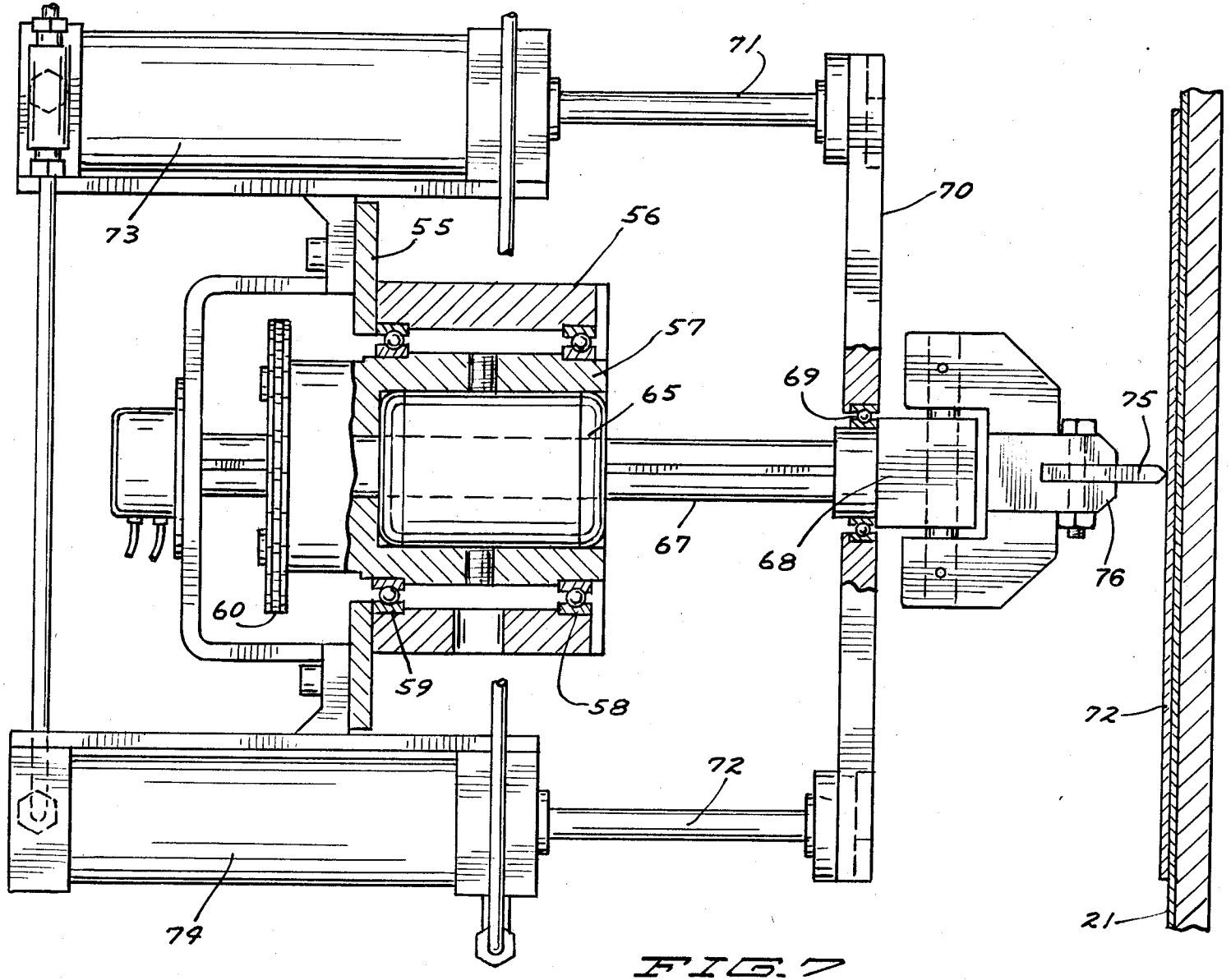
FIG. 7 is a fragmentary plan view, partly in section, showing details of the support for the slicker element.

A vertical plate 33 is supported by brackets 26 and 31 of the X motion carriage. Plate 33 in turn supports a bracket 34 which rigidly holds the top ends of a pair of parallel spaced apart vertical Y motion guide rails 35 and 36. Guide rails 35 and 36 are of structure similar to horizontal guide rails 15 and 18. The lower ends of guide rails 35 and 36 are rigidly secured in a bracket 37 forming part of a lower X motion carriage, indicated generally at 38 (FIGS. 3, 4 and 6). Bracket 37 is secured to the back surface of a vertical plate 39. The lower carriage 38 is supported on lower guide rail 18 by means of a pair of bushings 40 and 41 secured to the front surface of plate 39. It will be seen that the upper carriage 23 and lower carriage 38, along with guide rails 35 and 36, form a rigid assembly. Thus, when the upper carriage is driven to travel horizontally along upper guide rail 15, the lower carriage travels horizontally along guide rail 18.

Figure 5:
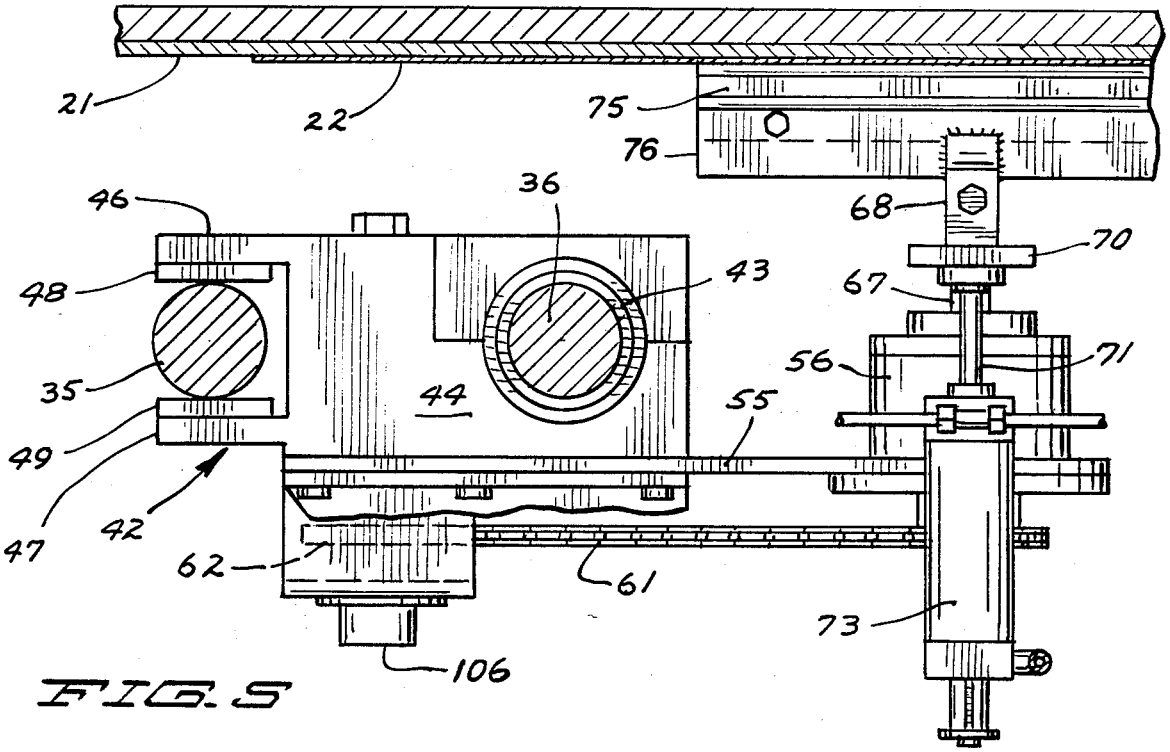
FIG. 5 is a horizontal section on a further enlarged scale on the line 5—5 of FIG. 3 and in the direction of the arrows, showing the support carriage in greater detail.

A Y motion carriage, indicated generally at 42, is mounted for vertical travel along guide rails 35 and 36. Y motion carrier 42 includes a cylindrical bushing 43 which engages guide rail 36 for vertical travel therealong. A pair of vertically spaced apart brackets 44 and 45 are secured to bushing 43 for travel therewith. The left hand edges of brackets 44 and 45 each have a pair of parallel spaced apart finger-like elements 46 and 47 (FIG. 5), each having on its inner surface a bushing plate 48 and 49, respectively, which engage guide rail 35 for maintaining Y carriage 42 stable in its vertical travel.

One end of a drive chain 50 is connected at 51 to Y carriage 42. Drive chain 50 extends downwardly to and around idler sprocket 52 journaled for rotation between bracket 37 and plate 39 of lower X motion carriage 38. The drive chain then extends upwardly to drive sprocket 53 driven by motor 54 supported on vertical plate 33 of upper X motion carriage 23. Thus, actuation of motor 54 causes the Y motion carriage to be driven vertically along guide rails 35 and 36. This may occur simultaneously with horizontal travel of the vertical guide rails and upper carriage 23 and lower carriage 38 along guide rails 15 and 18, respectively, by actuation of motor 32.

A vertical plate 55 is supported from the front edges of brackets 44 and 45 of the Y motion carriage. A cylindrical bearing cartridge housing 56 is secured to plate 55 with its longitudinal axis extending horizontally and perpendicular to the plate. A hub 57 is supported for rotation within housing 56 journaled by spaced apart ring bearings 58 and 59. A sprocket 60 is mounted on one end of hub 57. Sprocket 60 is driven by drive chain 61, in turn driven by drive sprocket 62 driven by motor 63, also mounted on plate 55. A ball spline 65 is mounted within hub 57 to rotate therewith. A splined shaft 67 extends through ball spline 65 for rotation with it and reciprocation in Z motion relative thereto.

One end of shaft 67 is fitted with a hub 68 which is journaled by bearing 69 for rotation relative to elongated plate 70. Plate 70 in turn is supported by piston rods 71 and 72 of air cylinders 73 and 74, respectively, which in turn are supported by plate 55. A slicker element in the form of a straight edged blade 75 is carried in a blade holder 76, in turn carried by hub 68 for rotation with shaft 67 and hub 57 when driven by motor 63. Blade 75 is disposed so as to be capable of applying pressure to the hide. It may be perpendicular as shown or may be disposed angularly relative to the surface of plate 21 and a hide carried by that surface in simulation of manual manipulation. Blade 75 is reciprocated toward and away from hide 22 by action of cylinders 73 and 74 and an adjustable controllable thrusting force is exerted to hold the blade edge in contact with the hide by the cylinders which are connected to a source of air under pressure. Alternatively, the slicker element may take the form of a small diameter elongated roller.

Figure 9:
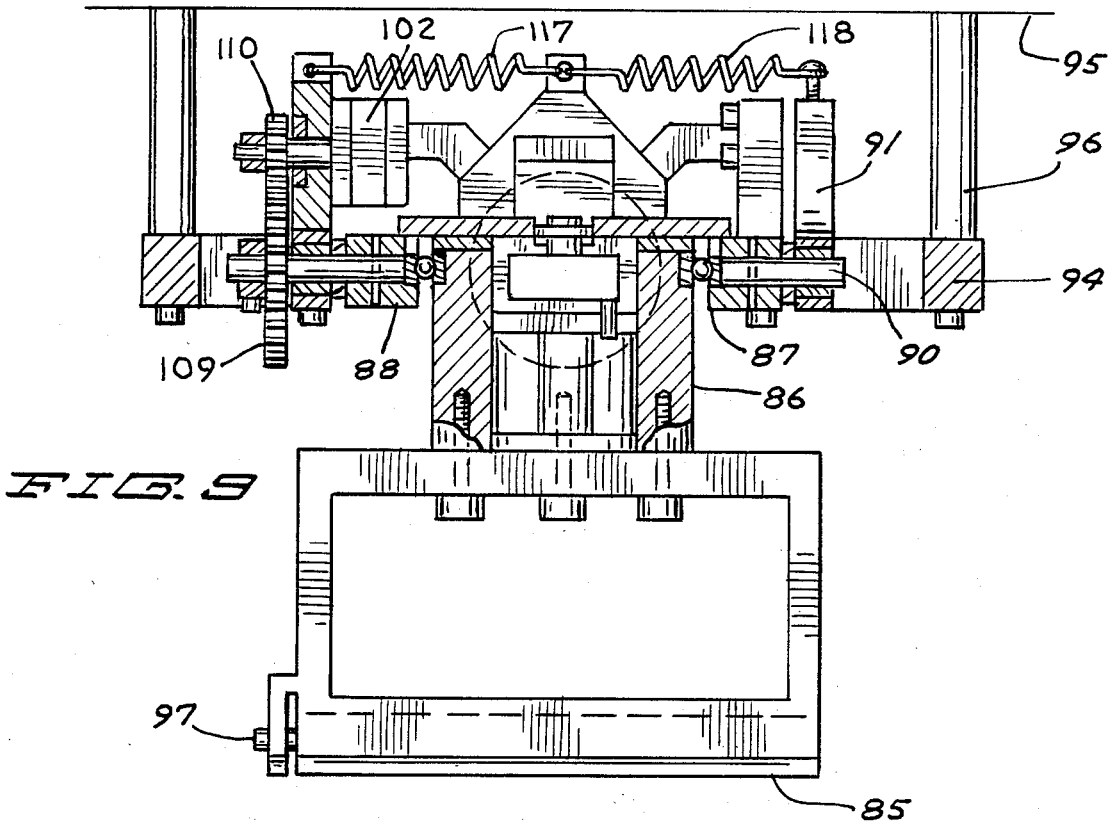
FIG. 9 is a horizontal section on the line 9—9 of FIG. 8 and in the direction of the arrows.
Figure 8:
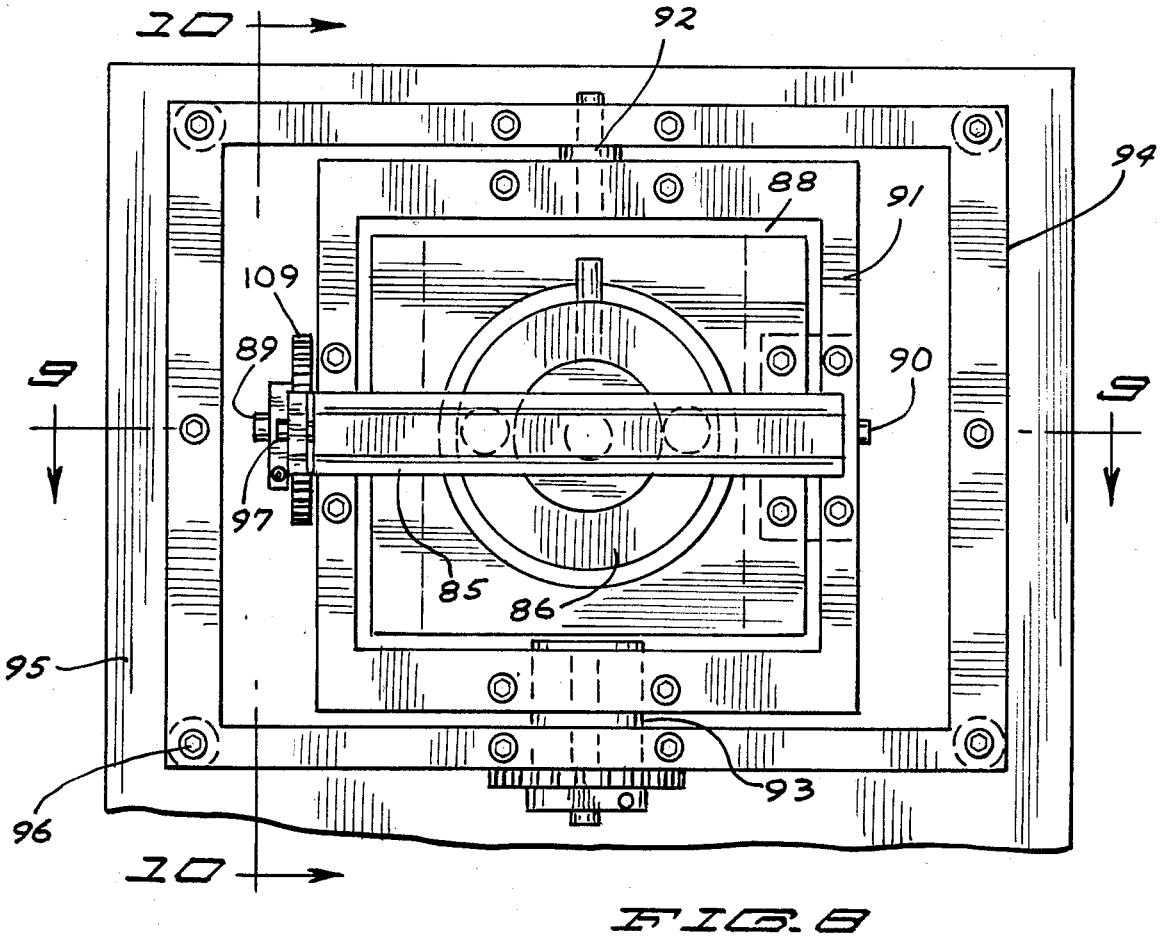
FIG. 8 is a fragmentary front elevation of the manual control means for the applicator apparatus.
Figure 10:
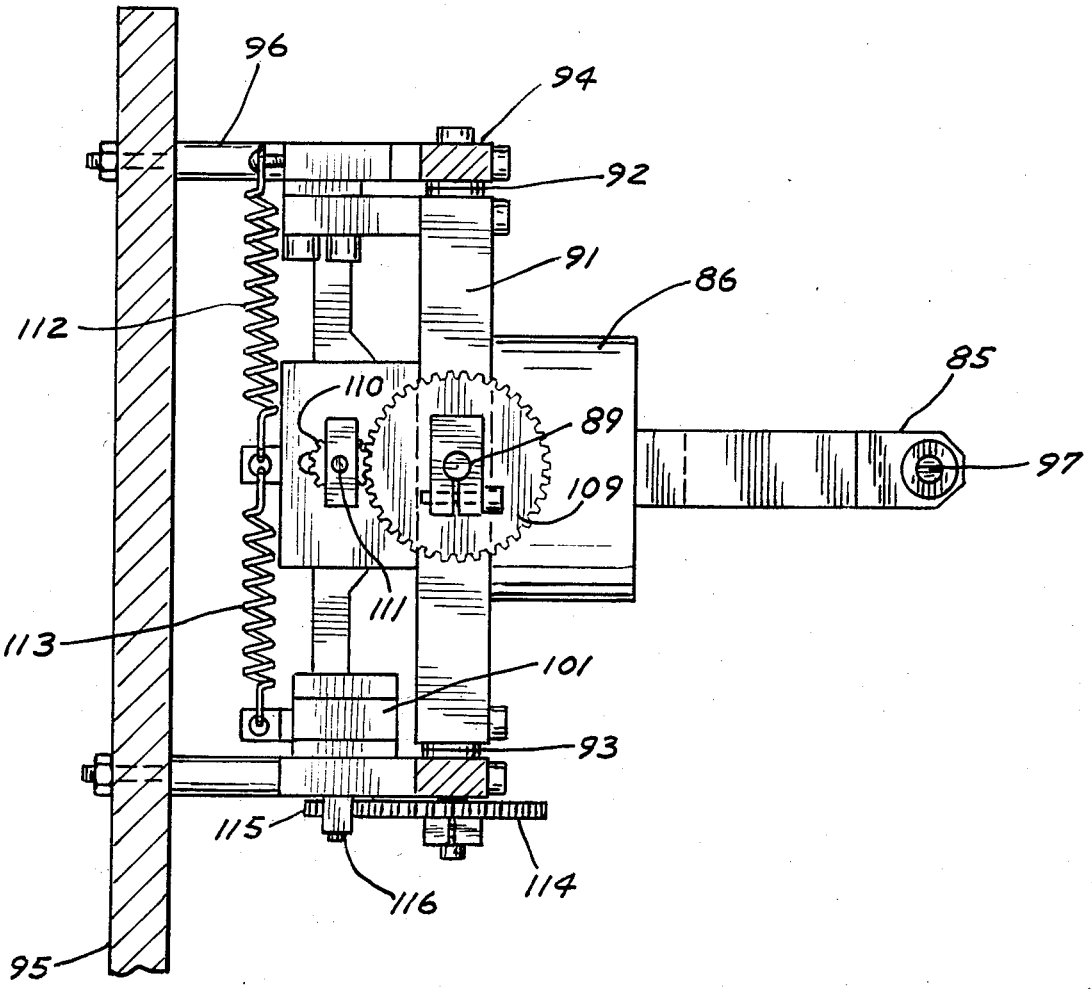
FIG. 10 is a vertical section on the line 10—10 of FIG. 8 and in the direction of the arrows.
Figure 22:
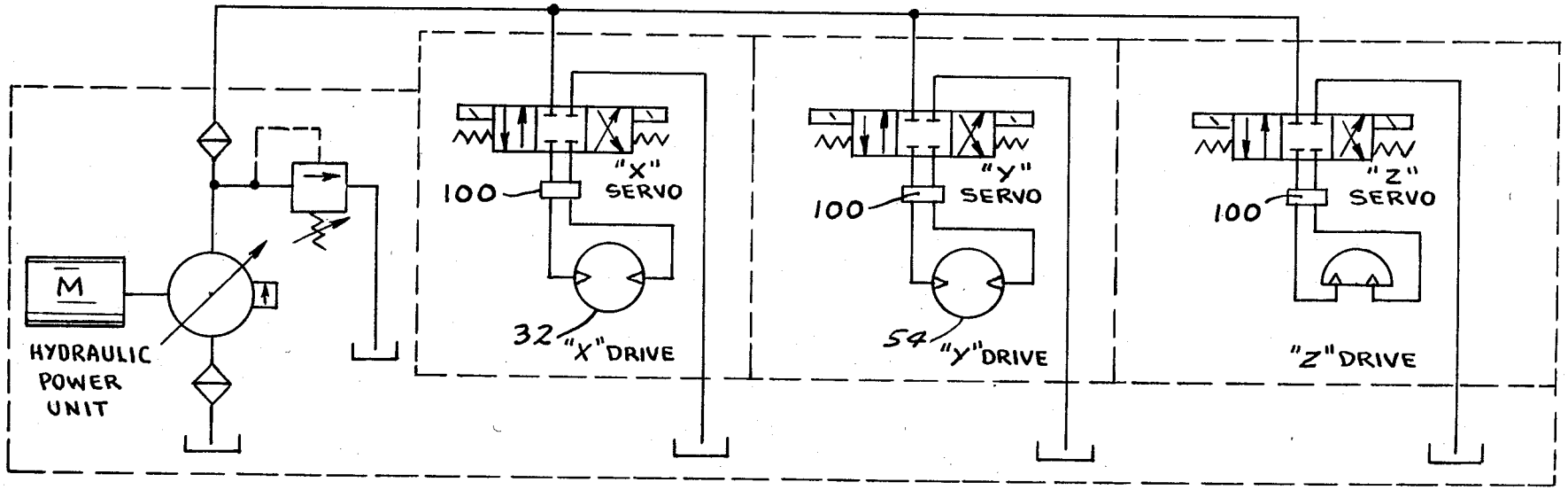
Figure 23:
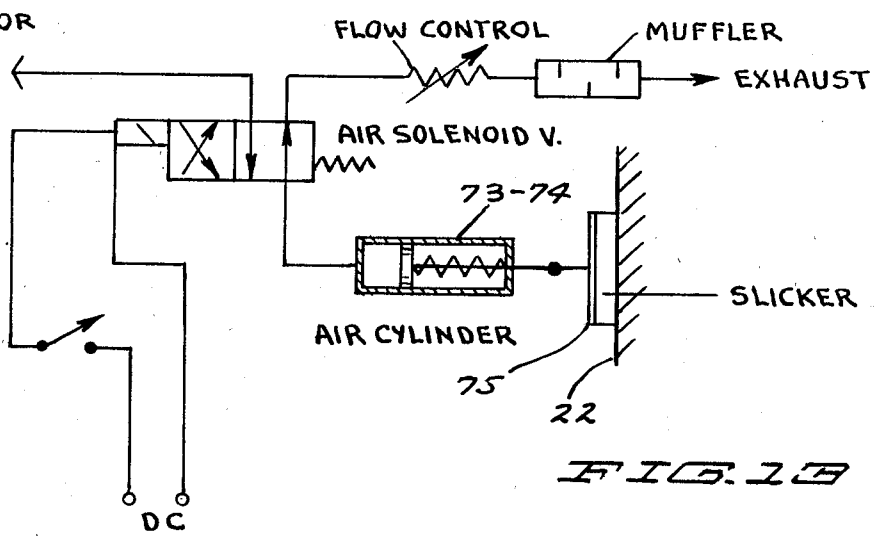
Figure 23A:
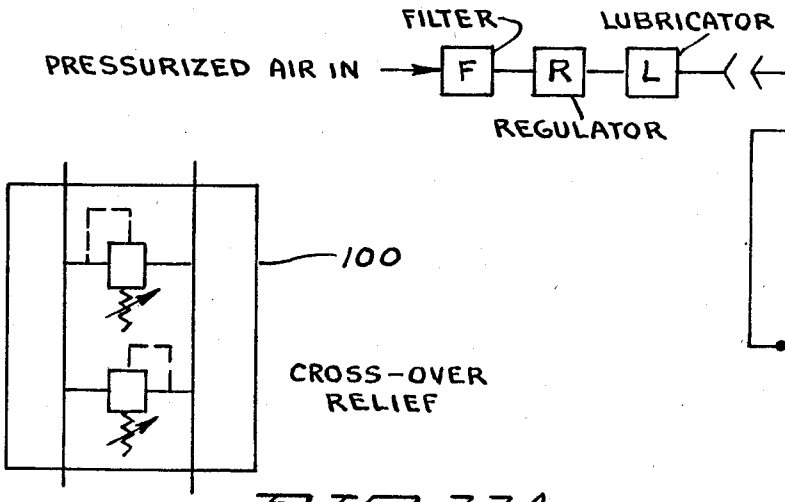

Manually operable control means for motors 32 and 54 operating X and Y motions, respectively, motor 63 operating rotation of the slicker element, and flow of air to cylinders 73 and 74 to operate thrust motion of the slicker element, are preferably spaced apart from the applicator apparatus, but in close proximity so that the operator at all times may view the applicator operation. The control assembly is shown in FIGS. 8, 9 and 10. A T-bar joy stick handle 85 is supported from a hub 86 journaled for rotation on bearings 87 within rectangular frame member 88. Frame 88 is pivoted at 89 and 90 in a gimbal arrangement for rotation about a horizontal axis within a frame 91. Frame 91 in turn is pivoted at 92 and 93 for rotation about a vertical axis within a fixed rectangular frame 94 which is secured to a support panel 95 and spaced therefrom by a plurality of spacer posts 96. A thumb switch 97 actuates the system, as shown schematically in FIGS. 12 and 13 for actuating cylinders 73 and 74 for moving the slicker blade 75 into contact with a hide to be flattened and stretched.

Figure 12:
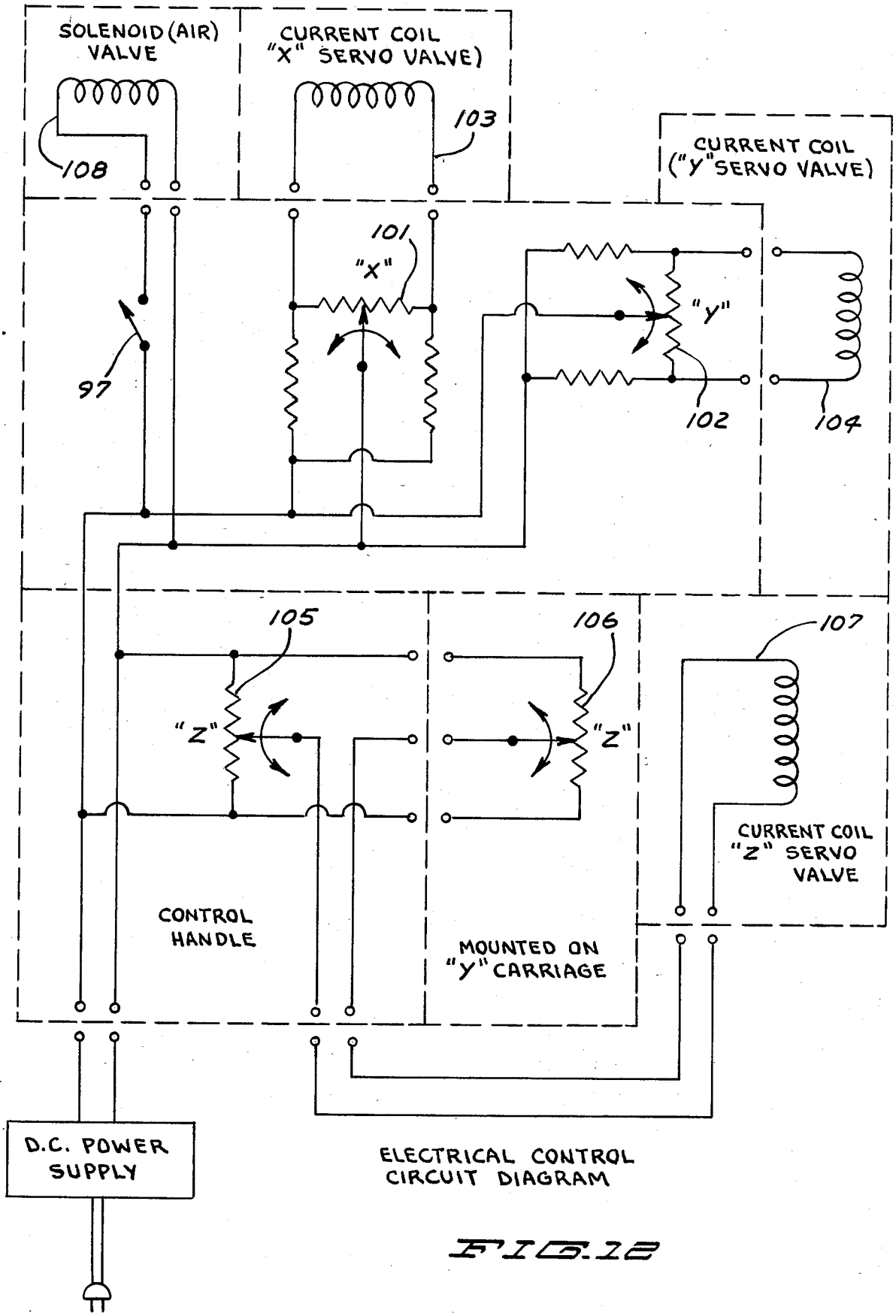
FIG. 12 is a schematic diagram of the electrical control circuit.

FIGS. 11 through 13 illustrate diagrammatically the power connections between the control assembly shown in FIGS. 8 to 10 and the several mechanical assemblies for operating the slicker element 75. Specifically, the means by which the actions initiated by manipulation of handle 85 are transmitted to the responsive mechanical elements are illustrated diagrammatically. In the hydraulic circuit of FIG. 11, a motor driven hydraulic pump provides a pressure/flow source of hydraulic fluid to the input ports of X, Y and Z servo valves. When a current flow from the electrical control circuit shown in FIG. 12 is directed to a servo valve, the servo valve will respond by shifting the spool of the valve in the direction dictated by the direction of the current flow and in proportion to the magnitude of the current. As described in detail hereinafter, the direction is dictated by the direction of movement of handle 85.

Movement of the valve spool provides hydraulic pressure and flow to the actuator in the circuit motor 32, 54 or 63. The actuator then moves at a rate proportional to the spool movement, which in turn is proportional to the electrical current received by the current coil (103, 104 or 107) of the corresponding servo valve. When the direction of flow of the control current to the control coil is reversed, the valve spool shifts in the opposite direction and thus reverses the direction of movement of the actuator. A cross-over relief valve 100, as shown in FIG. 11A, is provided in each actuator circuit. This valve is a variable pressure safety device to limit the force available in the event of a stalled actuator.

FIG. 12 illustrates the electrical control circuit. The X and Y bridges (potentiometers 101 and 102, respectively, both located on the control assembly) are both rate controlled systems. With the potentiometer wiper in the mid-position of its throw, no current will flow into the associated servo valve current coil (103 or 104). Upon moving the wiper from its mid-position, responsive to movement of handle 85 in its gimbal mounting, current flows in one direction through the solenoid valve current coil dependent upon the direction of movement of the handle. The farther the deviation of the wiper from its mid-position, the greater the current flow. Reversing the movement of the wiper to the other side of the mid-point on the potentiometer reverses the current flow direction through the servo valve current coil and again, the greater the movement of the wiper from the mid-point on the potentiometer, the greater the current flow.

The Z control is a closed loop servo circuit. A potentiometer 105 on the control handle is the master and a potentiometer 106 on the Z actuator motor 63 is the slave. Whenever position of the wiper of the potentiometer on the slave doesn't correspond to that of the master potentiometer, an appropriate current in the current coil 107 actuates the servo valve to drive the Z actuator 63 and slave potentiometer wiper to a position on the slave potentiometer in correspondence with the position on the master potentiometer. Driving of the Z actuator correspondingly drives the slicker element 75.

FIG. 13 illustrates the pneumatic circuit for actuating thrust force exerted on the slicker element. Air under pressure is filtered, pressure regulated and lubricated, prior to entry to an air solenoid valve. In normal operation, the air passes through the solenoid valve to the rod end of each air cylinder 73, 74 causing the slicker element 75 to remain at its fully retracted position. When the thumb switch 97 on the handle 85 is depressed, current flows through coil 108 and the air solenoid valve is actuated. This causes the air to be passed to the piston end of each air cylinder causing the slicker element to advance to the hide 22. The air pressure regulator is adjusted to attain the desired loading of the slicker element on the hide. The rate at which the slicker element traverses in or out is adjustable with the variable flow control.

Rotation of the T-bar handle 85 drives the wiper of the master Z potentiometer 105. A limit stop of 105 degrees on either side of the mid-position is provided. This potentiometer the slave potentiometer 106 and the current coil 107 of the Z servo valve constitute the Z drive closed servo loop.

In Y motion, rotation of frame 88 on pivot shafts 89 and 90 with respect to frame 91 rotates gear 109. Gear 109 meshes with pinion 110 mounted on Y potentiometer shaft 111 giving a potentiometer wiper movement proportional to movement of frame 88. Springs 112 and 113 keep frames 88 and 91 biased to a neutral center position, with the two frames being parallel and the wiper of the potentiometer 102 at its mid-point.

In X motion, rotation of frame 88 with respect to fixed frame 94 about pivot shafts 92 and 93 rotates gear 114 which meshes with pinion 115 mounted on shaft 116 of X potentiometer 101 giving a potentiometer wiper movement proportional to the movement of frame 88. Springs 117 and 118 keep frames 88 and 94 biased to a neutral central position with the two frames being parallel and with the wiper of the potentiometer at its mid-point.

It is apparent that many modifications and variations of this invention as hereinbefore set forth may be made without departing from the spirit and scope thereof. The specific embodiments described are given by way of example only and the invention is limited only by the terms of the appended claims.

The embodiments of the invention in which an exclusive property or privilege is claimed are defined as follows:

1. A power assist hide applicator apparatus for flattening and stretching a wet hide against a smooth planar surface for drying, said apparatus being adapted for positioning closely adjacent to the smooth flat plate upon which a hide is applied for subsequent drying on the plate according to conventional tannery practice, said apparatus comprising:

(A) support means holding a slicker element for positioning closely adjacent to a hide-carrying plate, said slicker element having a smooth straight edge rotatable in a plane parallel to the surface of the plate, (B) motor power assist means associated with the slicker element for rotating the same, (C) separate independent motor power assisted travel means for moving said support means in a plane parallel to and spaced from the surface of the hide-carrying plate and over an area substantially coextensive with the area of a hide on the plate, (D) further separate independent power assisted thrust means associated with the slicker element for moving the element on a path perpendicular to the surface of the hide-carrying plate into and out of contact with a wet hide carried on the plate, and exerting force on the element, and (E) manually operable spaced apart electric control means for actuating the power assist means for manipulating the slicker element over the surface of a hide in simulation of manual hide application.

2. An apparatus according to claim 1 wherein:

(A) said support means for the slicker element comprises a hub journaled for rotation about an axis perpendicular to the plane of the hide-carrying plate, (B) said power assist means associated with the slicker element for rotating the same comprises motor drive means for rotating said hub, (C) a splined shaft extends through said hub for rotation therewith and reciprocable movement relative thereto, (D) the slicker element is supported at one end of said shaft, and (E) said power assisted thrust means associated with the slicker element comprises drive means for reciprocating said shaft and slicker element.

3. An apparatus according to claim 2 wherein said reciprocation drive means comprises at least one fluid actuated piston.

4. An apparatus according to claim 1 wherein said slicker element is a blade.

5. An apparatus according to claim 1 wherein said power assisted travel means includes means for moving the support means in a first direction relative to the hide-carrying plate and means for moving the support means simultaneously or independently in a second direction substantially perpendicular to the first direction.

6. A power assist hide applicator apparatus for flattening and streching a wet hide against a smooth planar surface for drying, said apparatus being adapted for positioning closely adjacent to the smooth flat plate upon which a hide is applied for drying according to conventional tannery practive, said apparatus comprising:

(A) support means for holding a slicker element for positioning closely adjacent to a hide-carrying plate, said slicker element having a smooth straight edge rotatable in a plane parallel to the surface of the plate, (B) power assist means associated with the slicker element for rotating the same, (C) power assisted travel means for moving said support means in a plane parallel to and spaced from the surface of the hide-carrying plate and over an area substantially coextensive with the area of a hide on the plate, (D) power assisted thrust means associated with the slicker element for moving the element on a path perpendicular to the surface of the hide-carrying plate into and out of contact with a wet hide carried on the plate, and exerting force on the element, and (E) spaced apart control means for actuating the power assist means for manipulating the slicker element over the surface of a hide in simulation of manual hide application, (1) said control means being manually operable and comprising a handle journaled for rotation within a first frame, (2) said first frame being pivotally supported within a second frame for rotating along a first axis of rotation perpendicular to the axis of rotation of the handle, (3) said second frame being pivotally supported within a stationary frame for rotation about a second axis of rotation perpendicular to said first axis of rotation, and (4) a switch being provided in said handle.

7. An apparatus according to claim 6 wherein:

(A) electrical connection means between said handle and said power assist means for the slicker element causes rotation of said slicker element responsive to rotation of the handle, (B) electrical connection means between said first frame and said power assisted travel means causes movement of the slicker element support means in one direction responsive to pivoting of the frame, (C) electrical connection means between said second frame and said power assisted travel means causes movement of the slicker element support means in another direction, perpendicular to the first, responsive to pivoting of the second frame, and (D) electrical connection means between said handle switch and said power assisted thrust means causes reciprocable movement of the slicker element responsive to actuation of said switch.

8. A power assist hide applicator apparatus for flattening and stretching a wet hide against a smooth planar surface for drying, said apparatus being adapted for positioning closely adjacent to the smooth flat plate upon which a hide is applied for drying according to conventional tannery practice, said apparatus comprising:

(A) support means for holding a slicker element for positioning closely adjacent to a hide-carrying plate, said slicker element having a smooth straight edge rotatable in a plane parallel to the surface of the plate, (B) power assist means associated with the slicker element for rotating the same, (C) power assisted travel means for moving said support means in a plane parallel to and spaced from the surface of the hide-carrying plate and over an area substantially coextensive with the area of a hide on the plate, and also including means for moving the support means in a first direction relative to the hide-carrying plate and means for moving the support means simultaneously or independently in a second direction substantially perpendicular to the first direction and comprising:

(1) a pair of elongated vertically spaced apart parallel horizontal guide rails, (2) an X motion carriage mounted for horizontal movement along each of said guide rails, (3) a pair of elongated horizontally spaced apart parallel vertical guide rails supported at their opposite ends in said carriages, (4) a Y motion carriage mounted for vertical movement on said vertical guide rails, and (5) said support means for the slicker element being mounted on said Y motion carriage, (D) power assisted thrust means associated with the slicker element for moving the element on a path perpendicular to the surface of the hide-carrying plate into and out of contact with a wet hide carried on the plate, and exerting force on the element, and (E) spaced apart control means for actuating the power assist means for manipulating the slicker element over the surface of a hide in simulation of manual hide application.

9. An apparatus according to claim 8 wherein:

(A) said support means for the slicker element comprises a hub journaled for rotation about an axis perpendicular to the plane of the hide-carrying plate, (B) said power assist means associated with the slicker element for rotating the same comprises motor drive means for rotating said hub, (C) a splined shaft extends through said hub for rotation therewith and reciprocable movement relative thereto, (D) the slicker element is supported at one end of said shaft, and (E) said power assisted thrust means associated with the slicker element comprises drive means for reciprocating said shaft and slicker element.

10. An apparatus according to claim 9 wherein said reciprocation drive means comprises at least one fluid actuated piston.

11. An apparatus according to claim 6 wherein said power assisted travel means includes means for moving the support means in a first direction relative to the hide-carrying plate and means for moving the support means simultaneously or independently in a second direction substantially perpendicular to the first direction.

12. An apparatus according to claim 11 wherein:

(A) electrical connection means between said handle and said power assist means for the slicker element causes rotation of said slicker element responsive to rotation of the handle, (B) electrical connection means between said first frame and said power assisted travel means causes vertical movement of the Y motion carriage responsive to pivoting of the frame, about its first axis, (C) electrical connection means between said second frame and said power assisted travel means causes horizontal movement of the X motion and Y motion carriages responsive to pivoting of the second frame, about its second axis, and (D) electrical connection means between said handle switch and said power assisted thrust means causes reciprocable movement of the slicker element responsive to actuation of said switch.

13. An apparatus according to claim 12 wherein said first axis is horizontal and said second axis is vertical.

14. A power assist hide applicator apparatus for flattening and stretching a wet hide against a smooth planar surface for drying, said apparatus being adapted for positioning closely adjacent to the smooth flat plate upon which a hide is applied for drying according to conventional tannery practice, said apparatus comprising:

(A) a rigid frame including a pair of elongated vertically spaced apart parallel horizontal guide rails, (B) support means for holding a slicker element for positioning closely adjacent to a hide-carrying plate, said slicker element having a smooth straight edge rotatable in a plane parallel to the surface of the plate, (C) power assist means associated with the slicker element for rotating the same, (D) power assisted travel means for moving said support means in a plane parallel to and spaced from the surface of the hide-carrying plate and over an area substantially coextensive with the area of a hide on the plate, said power assisted travel means including:

(1) an X motion carriage mounted for horizontal movement along each of said horizontal guide rails, (2) motor drive means mounted on said frame for moving one of said X motion carriages, (3) a pair of elongated horizontally spaced apart parallel vertical guide rails supported at their opposite ends in said X motion carriages, (4) a Y motion carriage mounted for vertical movement on said vertical guide rails, said support means for the slicker element being mounted on said Y motion carriage, and (5) motor drive means mounted on one of said X motion carriages for moving said Y motion carriage, (E) power assisted thrust means associated with the slicker element for moving the element on a path perpendicular to the surface of the hide-carrying plate into and out of contact with a wet hide carried on the plate, and exerting force on the element, and (F) spaced apart control means for actuating the power assist means for manipulating the slicker element over the surface of a hide in simulation of manual hide application.

15. An apparatus according to claim 14 wherein:

(A) said support means for the slicker element comprises a hub journaled for rotation about an axis perpendicular to the plane of the hide-carrying plate, (B) said power assist means associated with the slicker element for rotating the same comprises motor drive means for rotating said hub, (C) a splined shaft extends through said hub for roatation therewith and reciprocable movement relative thereto, (D) the slicker element is supported at one end of said shaft, and (E) said power assisted thrust means assoicated with the slicker element comprises drive means for reciprocating said shaft and slicker element.

16. An apparatus according to claim 15 wherein said reciprocation drive means comprises at least one fluid actuated piston.

17. An apparatus according to claim 16 wherein said slicker element is a blade.

18. An apparatus according to claim 14 wherein:

(A) said control means comprises a handle journaled for rotation within a first frame, (B) said first frame is pivotally supported within a second frame for rotation about a horizontal axis, (C) said second frame is pivotally supported within a stationary frame for rotation about a vertical axis, and (D) a switch is provided on said handle.

19. An apparatus according to claim 18 wherein:

(A) electrical connection means between said handle and said power assist means for the slicker element causes rotation of said slicker element responsive to rotation of the handle, (B) electrical connection means between said first frame and said motor drive means for the Y motion carriage causes vertical movement of the Y motion carriage responsive to pivoting of the frame about its horizontal axis, (C) electrical connection means between said second frame and said motor drive means for the X motion carriage causes horizontal movement of the X motion and Y motion carriages responsive to pivoting of the second frame, about its vertical axis, and (D) electrical connection means between said handle switch and said power assisted thrust means causes reciprocable movement of the slicker element responsive to actuation of said switch.

20. A power assist hide application apparatus for flattening and stretching a wet hide against a smooth planar surface for drying, said apparatus being adapted for positioning closely adjacent to the smooth flat plate upon which a hide is applied for drying according to conventional tannery practice, said apparatus comprising:

(A) a rigid frame having a pair of vertical horizontally spaced apart standards and a pair of elongated vertically spaced apart parallel horizontal guide rails, (B) an X motion carriage mounted for horizontal movement along each of said guide rails, (C) motor drive means mounted on said frame for moving one of said X motion carriages, (D) a pair of elongated horizontally spaced apart parallel vertical guide rails supported at their opposite ends in said X motion carriages, (E) a Y motion carriage mounted for vertical movement on said vertical guide rails, (F) motor drive means mounted on one of said X motion carriages for moving said Y motion carriage, (G) support means mounted on said Y motion carriage for holding a slicker element for positioning closely adjacent to a hide-carrying plate, said support means comprising:

(1) a hub journaled for rotation about an axis perpendicular to the plane of the hide-carrying plate, (2) motor drive means for rotating said hub, (3) a splined shaft extending through said hub for rotation therewith and reciprocable movement relative thereto, (4) a slicker element having a smooth straight edge and supported at one end of said shaft for rotation in a plane parallel to the surface of the plate, and (5) drive means for reciprocating said shaft and slicker element comprising at least one fluid actuated piston, and (H) spaced apart manually operable control means for actuating the drive means for manipulating the slicker element over the surface of a hide in simulation of manual hide application.

21. An apparatus according to claim 20 wherein:

(A) said control means comprises a handle journaled for rotation within a first frame, (B) said first frame is pivotally supported within a second frame for rotation about a horizontal axis, (C) said second frame is pivotally supported within a stationary frame for rotation about a vertical axis, and (D) a switch is provided on said handle.

22. An apparatus according to claim 21 wherein:

(A) electrical connection means between said handle and said drive means for the hub of the slicker element support means causes rotation of said slicker element responsive to rotation of the handle, (B) electrical connection means between said first frame and said Y motion drive means causes vertical movement of the Y motion carriage responsive to pivoting of the frame about its horizontal axis, (C) electrical connection means between said second frame and said X motion drive means causes horizontal movement of the X motion and Y motion carriages responsive to pivoting of the second frame, about its vertical axis, and (D) electrical connection means between said handle switch and said reciprocating drive means causes reciprocable movement of the slicker element responsive to actuation of said switch.

23. An apparatus according to claim 20 wherein said slicker element is a blade.

24. A power assist hide applicator apparatus for flattening and stretching a wet hide against a smooth planar surface for drying, said apparatus being adapted for positioning closely adjacent to the smooth flat plate upon which a hide is applied for drying according to conventional tannery practice, said apparatus comprising:

(A) a rigid frame including a first pair of elongated spaced apart parallel guide rails, (B) support means for holding a slicker element for positioning closely adjacent to a hide-carrying plate, said slicker element having a smooth straight edge rotatable in a plane parallel to the surface of the plate, (C) power assist means associated with the slicker element for rotating the same, (D) power assisted travel means for moving said support means in a plane parallel to and spaced from the surface of the hide-carrying plate and over an area substantially coextensive with the area of a hide on the plate, said power assisted travel means including:

(1) a first motion carriage mounted for movement along each of said first guide rails, (2) motor drive means mounted on said frame for moving one of said first motion carriages, (3) a second pair of elongated spaced apart parallel guide rails perpendicular to said first pair of guide rails and supported at their opposite ends in said first motion carriages, (4) a second motion carriage mounted for movement on said second guide rails, said support means for the slicker element being mounted on said second motion carriage, and (5) motor drive means mounted on one of said first motion carriages for moving said second motion carriage, (E) power assisted thrust means associated with the slicker element for moving the element on a path perpendicular to the surface of the hide-carrying plate into and out of contact with a wet hide carried on the plate, and exerting force on the element, and (F) spaced apart control means for actuating the power assist means for manipulating the slicker element over the surface of a hide in simulation of manual hide application.

* * * * *